United States Patent [19]

Koga et al.

[11] Patent Number: 4,855,612

[45] Date of Patent: Aug. 8, 1989

[54] SWITCHING CURRENT AND A RELAY DEVICE EMPLOYED THEREIN

[75] Inventors: Hirofumi Koga, Kyoto; Katsumi Koyanagi, Nagaokakyo, both of Japan

[73] Assignee: Omron Tateisi Electronics Co., Kyoto, Japan

[21] Appl. No.: 166,301

[22] Filed: Mar. 10, 1988

Related U.S. Application Data

[63] Continuation of Ser. No. 675,185, Nov. 27, 1984, Pat. No. 4,772,809.

[30] Foreign Application Priority Data

Nov. 28, 1983 [JP] Japan ..... 58-225223

[51] Int. Cl.[4] ..... H01H 33/59

[52] U.S. Cl. ..... 307/140; 307/115; 307/134; 361/8; 361/13; 361/100; 361/104

[58] Field of Search ..... 307/132 E, 132 EA, 132 M, 307/134, 135, 137, 139, 140, 115, 141, 141.4; 361/2, 139, 8, 143, 155, 11, 156, 160, 9, 166, 174, 10, 100, 195, 196, 197, 198, 203, 205, 3, 13, 12; 335/128, 135

[56] References Cited

U.S. PATENT DOCUMENTS

| | | | |
|---|---|---|---|
| 3,430,063 | 2/1969 | Webb | 361/13 |
| 3,558,910 | 1/1971 | Dale | 307/134 |
| 3,588,605 | 6/1971 | Casson | 361/13 |
| 3,639,808 | 2/1972 | Ritzow | 361/13 |
| 3,783,305 | 1/1974 | Lefferts | 361/13 |
| 3,868,549 | 2/1975 | Schaefer et al. | 361/13 |
| 4,038,584 | 7/1977 | Tarchalski et al. | 361/104 |
| 4,156,885 | 5/1979 | Baker et al. | 361/100 |
| 4,251,845 | 2/1981 | Hancock | 361/8 |
| 4,389,691 | 6/1983 | Hancock | 361/8 |
| 4,525,762 | 6/1985 | Norris | 361/8 X |

*Primary Examiner*—William M. Shoop, Jr.
*Assistant Examiner*—Paul Ip
*Attorney, Agent, or Firm*—Wegner & Bretschneider

[57] ABSTRACT

A switching circuit for supplying electric power to a load from a power source includes a first relay device having a first switch and a semiconductor switching element connected in series with the first switch, power source and load. A second relay device is provided which is defined by a second switch connected parallelly to the semiconductor switching element and an actuating switch for enabling and disabling the semiconductor switching element. The second relay device is so arranged as to effect the make of the actuating switch and second switch in said order and to effect the break of the same in the opposite order. A delay circuit is provided for controlling the first and second relay devices such that when supplying a current to the load, the first and second relay devices are turned on in said order so that the first switch, the actuating switch and the second switch are turned on in said order. And, when cutting off the current to the load, the first switch, the actuating switch and the second switch are turned off in the opposite order.

8 Claims, 4 Drawing Sheets

SWITCHING CURRENT AND A RELAY DEVICE EMPLOYED THEREIN

This application is a continuation of Ser. No. 675,185, filed Nov. 7, 1984, now U.S. Pat. No. 4,772,809.

BACKGROUND OF THE INVENTION

1. Field of the invention

The present invention relates to a switching circuit for controlling, e.g., AC power, and also to a relay device employed therein.

2. Description of the Prior Art

A switching circuit is known which is defined by a combination of one or more relay devices and a semiconductor switching element, such as a thyristor circuit or a triac circuit. The prior art switchng circuit is so arranged that the semiconductor switching element is connected directly in series with a load and a power source. To start the power supply, the semiconductor switching element is turned on by a suitable gate signal. Then, during the power supply, the current constantly flows through the semiconductor switching element, thereby undesirably heating the semiconductor. This may result in a breakdown of the semiconductor. To prevent such heating, a bypass circuit is provided parallelly to the semiconductor switching element in such a manner as to close the bypass circuit after the switching element turns on, and to open the same before the switching element turns off. Thus, during the power supply, other than the moments for starting and cutting the power supply, the current flows through the bypass circuit, thereby preventing the switching element from being heated up undersirably.

However, the above switching circuit has the following problems. The first problem is the difficulty in controlling the semiconductor switching element and the bypass circuit in a predetermined timed relationship with each other. For example, if the semiconductor switching element is turned off first and then the bypass circuit is cut, undesirable arc current may be produced in the contacts in the bypass circuit, resulting in the generation of undesirable surge. Also, such an arc current may damage the contact points. The second problem is the breakdown of the semiconductor switching element. Although the bypass circuit is provided to protect the semiconductor switching element, the surge may be applied to the semiconductor switching element, resulting in the breakdown of the same. When this happens, the control of the current flowing through the semiconductor switching element will be lost and, thus, the current constantly flows through the load.

SUMMARY OF THE INVENTION

The present invention has been developed with a view to substantially solving the above described problems and has for its essential object to provide an improved switching circuit which can protect the semiconductor switching element from being damaged, such as from the breakdown.

It is also an essential object of the present invention to provide a switching circuit which can protect a load connected thereto even if breakdown of the semiconductor switching element should take place.

It is a further object of the present invention to provide a relay device which is particularly suitable for the above described switching circuit.

In accomplishing these and other objects, according to the present invention, a switching circuit for supplying electric power to a load from a power source comprises a first relay device having a first switch and a semiconductor switching element connected in series with the first switch, power source and load. A second relay device is provided which is defined by a second switch connected parallelly to the semiconductor switching element and an actuating switch for enabling and disabling the semiconductor switching element. The second relay device is so arranged as to effect the make of the actuating switch and second switch in said order and to effect the break of the same in the opposite order. A delay circuit is provided for controlling the first and second relay devices such that when supplying a current to the load, the first and second relay devices are turned on in said order so that the first switch, the actuating switch and the second switch are turned on in said order. And, when cutting off the current to the load, the first switch, the actuating switch and the second switch are turned off in the opposite order.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

Figure 1:
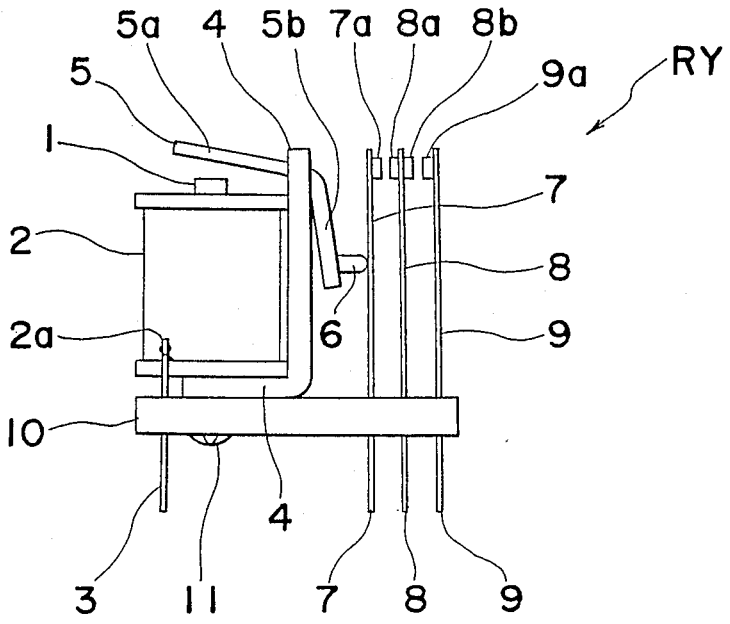
FIG. 1 is a side view of a relay device according to the present invention.

Referring to FIG. 1, a relay device RY according to the present invention is shown. Relay device RY comprises a base plate 10 on which a coil arrangement is fixedly mounted by a suitable securing means, such as a screw 11. The coil arrangement comprises a ferrite core 1 and a coil 2 wound on core 1. A yoke 4, having an L-shape configuration is rigidly connected to the bottom side of the coil arrangement and extends upwardly and parallelly to the axis of core 1. A bar 5 slightly bent at the center thereof is pivotally supported at the upper end portion of yoke 4 such that one end portion 5*a* bar 5 is located at a position capable of being attracted by core 1 and the other end portion 5*b* is located adjacent yoke 4. The other end portion 5*b* of bar 5 has a projection 6 which extends therefrom in the direction away from the coil arrangement. The opposite ends (only one end 2*a* is shown in FIG. 1) of coil 2 are connected to a pair of terminal pins (only one terminal pin 3 is shown in FIG. 1), which are mounted in base plate 10, so as to provide an electric current to coil 2.

Provided operatively in association with bar 5 are three elongated plates 7, 8 and 9 parallelly to each other and aligned in a direction of movement of projection 6. Plates 7, 8 and 9 are made of electrically conductive material and are fixedly mounted in base plate 10 through the step of pressure fitting or insert molding or any other known step. Plates 7 and 8 are made of a resilient material, but plate 9 is made of a rigid material. At the upper end portion plate 7 a contact 7*a* is provided. Similarly, plate 8 has contacts 8*a* and 8*b* and plate 9 has contact 9*a*. Contacts 7*a* and 8*a* are facing each other and contacts 8*b* and 9*a* are facing each other, and these contacts are normally spaced apart.

The operation of relay device RY will be explained hereinbelow. When current is applied to coil 2, the coil arrangement is excited, thereby pulling the end portion 5a of bar 5 towards core 1. Thus, bar 5 is pivoted counterclockwise about its center portion to push plate 7 towards plate 9. Thus, contacts 7*a* and 8*a* are connected with each other first, and then, contacts 8*b* and 9*a* are connected with each other. During the excitation of the coil arrangement, the contacts are held in the connected position as described above. Then, when the power to the coil arrangement is cut off, first contacts 8*b* and 9*a* separate from each other, and then, contacts 7*a*and 8*a*separate from each other. Such separations can be achieved by the resiliency of plates 7 and 8. As apparent from the above, since two different pairs of contacts are made sequentially, the above described relay device is referred to as a make-make relay device.

Figure 2:
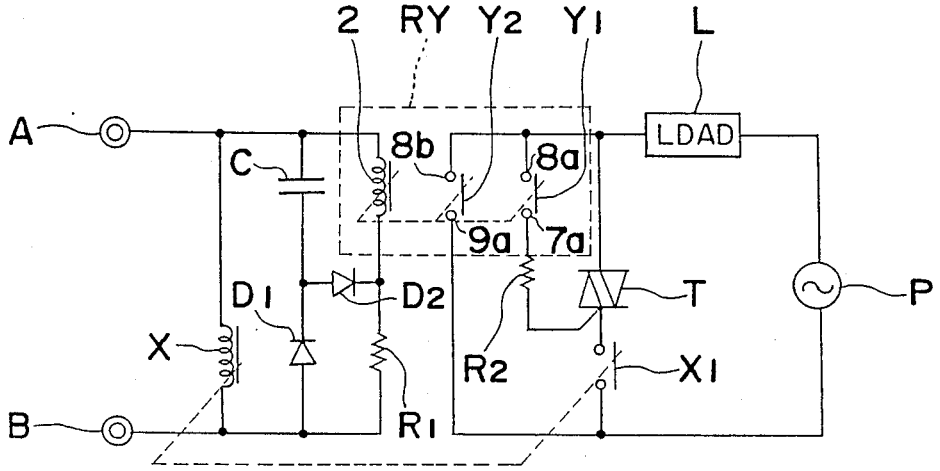
FIG. 2 is a circuit diagram of a switching circuit according to the present invention.
Figure 3:
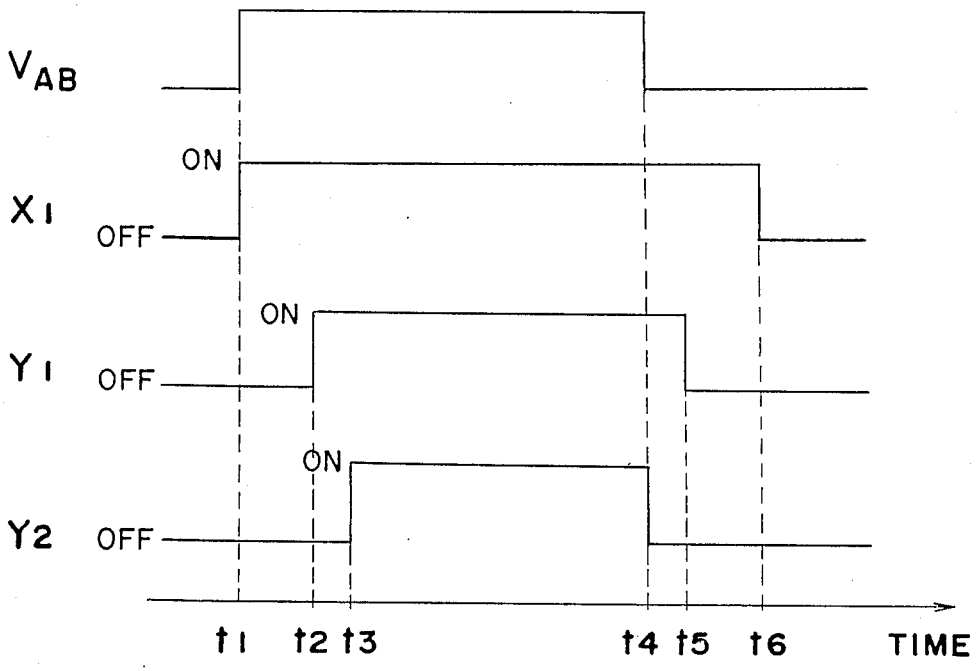
FIG. 3 is a time chart showing signals obtained at major points in the circuit of FIG. 2.

Referring now to FIG. 2, a switching circuit according to the present invention is shown. The circuit comprises a pair of input terminals A and B for receiving a signal $V_{AB}$ (FIG. 3). During the presence of signal $V_{AB}$, the switching circuit is maintained in the on state. Connected between input terminals A and B is a relay coil X which actuates a relay switch X1, which will be described later. Also connected between input terminals A and B is a series connection of diode D1 and capacitor C. Furthermore, a series connection of a resistor R1 and coil 2, which is the coil provided in the relay device of FIG. 1, is connected between terminals A and B. A diode D2 is connected between a junction between capacitor C and diode D1 and a junction between coil 2 and resistor R1.

The switching circuit of FIG. 2 further comprises a semiconductor switching element, such as a triac T, which is connected in series with relay switch X1. The series connection of triac T and relay switch X1 is connected parallelly with a relay switch Y2, and also parallelly with a series connection of AC power source P and load L. Relay switch Y2 is defined by contacts 8*b* and 9*a* provided in the relay device of FIG. 1. The gate of triac T is connected through a resistor R2 and a relay switch Y1 to the opposite side of triac T. Relay switch Y1 is defined by contacts 7*a* and 8*a* provided in the relay device of FIG. 1.

As understood from the above, a circuit enclosed by a dotted line represents the relay device of FIG. 1.

Next the operation of the switching circuit of FIG. 2 will be described with reference to the time chart shown in FIG. 3.

When signal $V_{AB}$ appears across terminals A and B at a time t1, coil X is excited to close relay switch X1. At this time, since triac T is not yet enabled, no current will flow through load L from power source P. Also, when signal $V_{AB}$ is applied, a current from terminals A and B flows through capacitor C, diode D2 and resistor R1, thereby charging capacitor C. When capacitor C is charged to a predetermined level, a current flows from capacitor C through diode D2 and coil 2 so that relay device RY is actuated to close relay switches Y1 and Y2 sequentially. More specifically, relay switch Y1 closes at time t2, and thereafter, relay switch Y2 closes at time t3. Thus, the operation of relay device RY is delayed with respect to the operation of a relay device defined by coil X and relay switch X1. Such a delay is achieved by a delay circuit defined by capacitor C and resistor R1.

Accordingly, relay switches X1, Y1 and Y2 close sequentially in said order. When relay switch Y1 closes at time t2, a signal is applied to the gate of triac T. Accordingly, at time t2, a load current starts to flow from power source P through load L. triac T and relay switch X1. Then, at time t3, relay switch Y2 closes to establish a bypass circuit. Thus, the load current also flows through relay switch Y2. Since the impedance of relay switch Y2 is very small when compared with that of triac T and relay switch X1, the load current flows intensively through relay switch Y2 and little load current flows through triac T. Accordingly, triac T will not be heated by the load current, and thus, it can be protected from heat damage.

Then, when signal $V_{AB}$ disappears from terminals A and B at a time t4, coil 2 is de-energized. However, coil X is further maintained excited by a current from capacitor C. Accordingly, by the de-energization of coil 2, relay switch Y2 opens at time t4 and, thereafter, a relay switch Y1 opens at a time t5. Then, when capacitor C is discharged, coil X is de-energized to open relay switch X1 at a time t6. Accordingly, relay switches Y2, Y1 and X1 open sequentially in said order. When relay switch Y2 opens at time t4, the load current, which has been flowing through relay switch Y2, now flows intensively through triac T. Accordingly, since the opening of the relay switch Y2 does not interrupt the load current flow, but merely to change the path thereof, no arc current or surge will be produced upon opening of relay switch Y2. Then, when relay switch Y1 opens at time t5, the signal to the gate of triac T is cut off. Accordingly, triac T cuts off the load current at the zero-crossing point in a known manner. Thereafter, relay switch X1 opens to ensure the interruption of current path through triac T.

According to the present invention, since switch X1 is provided in series with triac T, the load current can be interrupted even when triac T is damaged to lose its current interruption function.

Furthermore, since the made of relay switches Y1 and Y2 are effected in said order, and the break of the same are effected in the opposite order, i.e., Y2 and Y1, no surge or arc current will be produced upon make or break of relay switch Y2.

Moreover, since relay switches Y1 and Y2 are constructed in a single relay device with the make and break of switches Y1 and Y2 accomlished in the required order, it is not necessary to provide any control means to the circuit of FIG. 2.

Furthermore, since the make of relay switch X1 is effected before the make of relay switches Y1 and Y2, and the break of relay switch X1 is effected after the break of relay switches Y1 and Y2, no surge or arc current will be produced upon make or break of relay switch X1.

Figure 4:
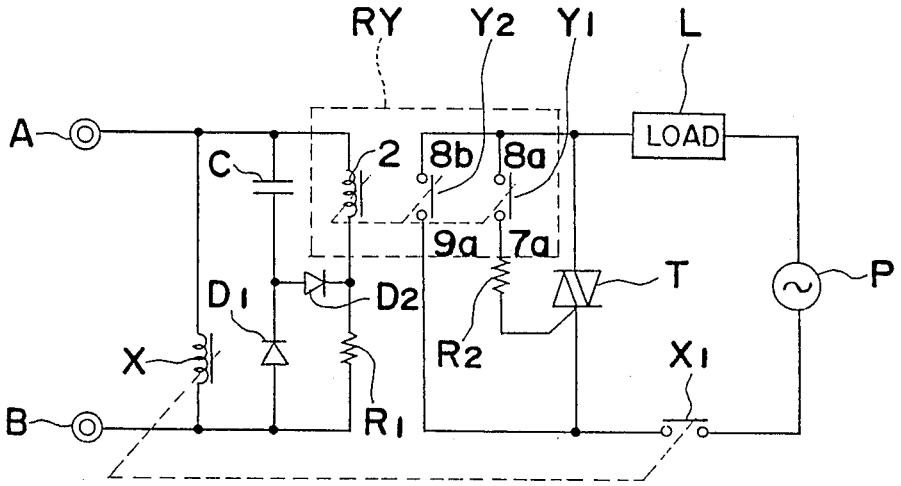
FIG. 4 is a circuit diagram similar to FIG. 2, but particularly showing a modification thereof.

Referring to FIG. 4, a modification of the switching circuit of the present invention is shown. When compared with the switching circuit of FIG. 2, the difference is the position where relay switch X1 is connected.

According to this modification, relay switch Y1 is connected parallelly to triac T only, and both triac T and relay switch Y2 are connected in series with relay switch X1. The operation of this modification is the same as that of the above embodiment.

Figure 5:
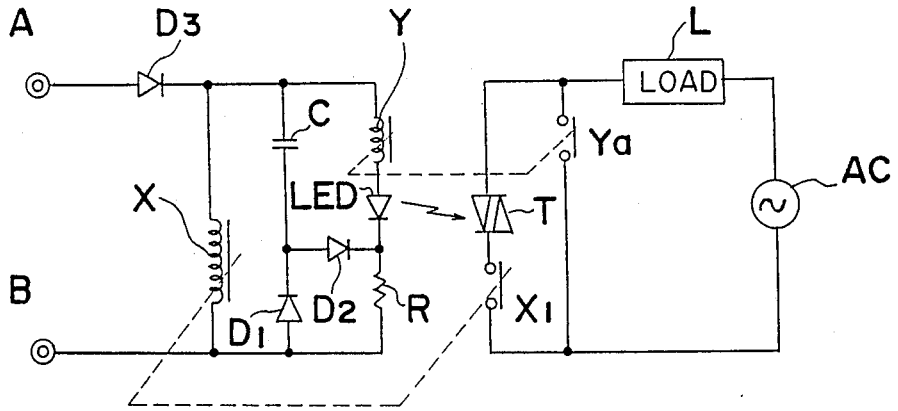
FIG. 5 is a circuit diagram similar to FIG. 2, but particularly showing another modification thereof.
Figure 6:
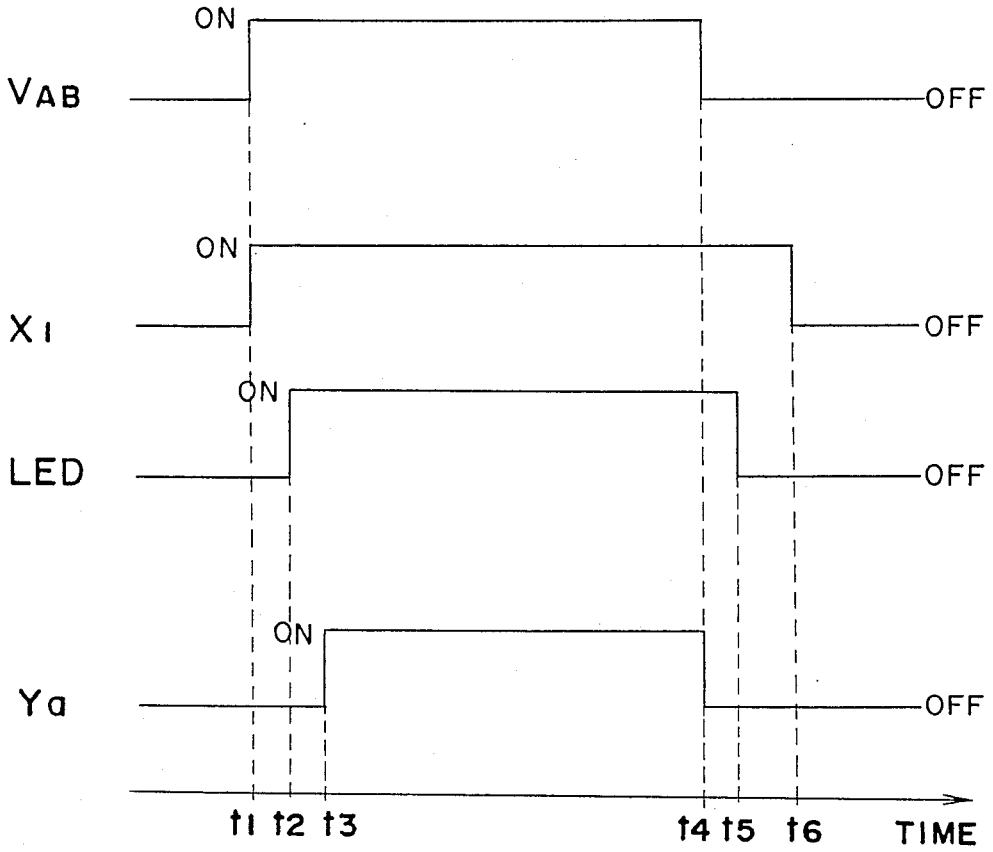
FIG. 6 is a time chart showing signals obtained at major points in the circuit of FIG. 5.

Referring to FIG. 5, another modification of the switching circuit of the present invention is shown. When compared with the switching circuit of FIG. 2, the difference is in the relay device and in the semiconductor switching element. Instead of triac, a bidirectional light activated thyristor T is employed. In place of coil 2, a coil Y is provided which actuates a relay switch Ya. Relay switch Ya is identical to relay switch Y2 in the above described embodiment and is provided for controlling the bypass circuit. A light emitting diode LED is connected in series with coil Y. The operation is described below in connection with the time chart of FIG. 6.

When signal $V_{AB}$ appears across terminals A and B at a time t1, coil X is excited so as to close relay switch X1. At this time, since bidirectional light activated thyristor T is not yet enabled, no current will flow through load L from power source P. Also, when signal $V_{AB}$ is applied, a current from terminals A and B flows through capacitor C, diode D2 and resistor R1, thereby charging capacitor C. When capacitor C is charged to a first predetermined level (time t2), a current flows from capacitor C through diode D2, light emitting diode LED and coil Y. At this charged level, light emtting diode LED emits enough light to enable bidirectional light activated thyristor T, but coil Y is not excited enough to close relay switch Ya. Then, upon further charging of capacitor C to a second predetermined level (time t3), coil Y is excited so as to close relay switch Ya. Thus, relay switch X1, light emitting diode LED and relay switch Ya are actuated in said order. Thus, the load current first flows through bidirectional light activated thyristor T and, then, through the bypass defined by relay switch Ya.

Then, when signal $V_{AB}$ disappears from terminals A and B at a time t4, coil Y is de-energized to open relay switch Ya. Then, light emitting diode LED is dimmed to disable bidirectional light activated thyristor T to cut off the load current at the zero-crossing point (time t5). Thereafter, relay switch X1 opens (time t6) to ensure the interruption of current path through bidirectional light activated thyristor T.

Figure 7:
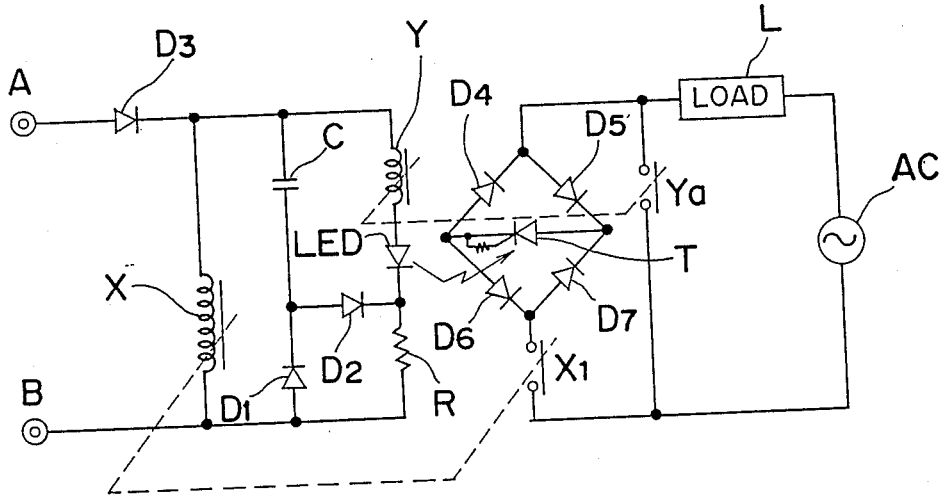
FIG. 7 is a circuit diagram similar to FIG. 5, but particularly showing a further modification thereof.

Referring to FIG. 7, a further modification of the switching circuit of the present invention is shown. When compared with the switching circuit of FIG. 5, the difference is in the semiconductor switching element. Instead of bidirectional light activated thyristor T, a light activated thyristor (LASCR) T is employed together with diodes D4, D5, D6 and D7 connected in a bridge configuration. When LASCR T turns on, AC current flows through diode D5, LASCR T, diode D6 and relay switch X1 in a half cycle and through relay switch X1, diode D6 LASCR T and diode D4 in the other half cycle. The other operations are the same as the modification of FIG. 5.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of the appended claims.

What is claimed is:

1. A switching circuit for supplying electric power to a load from a power source, comprising:

a semiconductor switching element connected in series with the power source and load;

first relay switch means for connecting the load and power source, wherein said first relay switch means is connected in parallel with said semiconductor switching element and has an impedance which is substantially less than that of the semiconductor switching element, and a second relay switch means;

gating means for enabling and disabling said semiconductor switching element, wherein said second relay switch means and said gating means are connected in series with each other and delay circuit means for controlling said first and said second relay switch means and said gating means, said delay circuit having a capacitor, such that:

when supplying current to the laod, said gating means first enables said semiconductor switching element so that current flows from the power source to the load only through said semiconductor switching element, and then said first relay switch means is turned on so that current flows from the power source to the load through said relay switch means; and when cutting off the current to the load, said second relay switch means is turned off first so that current flows from the power source to the load only through said semiconductor switching element, and then said gating means is operated so as to disable said semiconductor switching element so that no current flows from the power source to the load.

2. A switching circuit as claimed in claim 1, wherein said semiconductor switching element is a bidirectional light activated thyristor, and said gating means is a light emitting diode.

3. A switching circuit as claimed in claim 1, wherein said semiconductor switching element is a light activated thyristor which is connected in a bridge configuration between four diodes, and said gating means is a light emitting diode.

4. A switching circuit for supplying electric power to a load from a power source, comprising:

a semiconductor switching element connected in series with the power source and load;

first relay switch means for connecting the load and power source, wherein said first relay switch means is connected in parallel with said semiconductor switching element and has an impedance which is substantially less than that of the semiconductor switching element;

gating means for enabling and disabling said semiconductor switching element;

second relay switch means connected in series with the power source, the load, and said semiconductor switching element; and delay circuit means for controlling said first and second relay switch means and said gating means, such that:

when supplying current to the load, said second relay switch means is first turned on so as to connect said semiconductor switching element to the source and the load, then said gating means enables said semiconductor switching element, thereby enabling said semiconductor switching element so that current flows from the power source to the load only through said semiconductor switching element, and then said first relay switch means is turned on so that current flows from the power source to the load through first second relay switch means; and when cutting off the current to the load, said first relay switch means is turned off first so that current flows from the power source to the load only through said semiconductor switching element, and then said gating means is operated so as to disable said semiconductor switching element, thereby disabling the semiconductor switching element so that no current flows from the power source to the load, and then said third relay switch means is turned off so as to disconnect the semiconductor switching element from the power source and the load.

5. A switching circuit as claimed in claim 4, wherein said semiconductor switching element is a bidirectional light activated thyristor, and said gating means is a light emitting diode.

6. A switching circuit as claimed in claim 4, wherein said semiconductor switching element is a light activated thyristor which is connected in a bridge configuration between four diodes, and said gating means is a light emitting diode.

7. A switching circuit as claimed in claim 4, wherein said first relay switch means and said gating means are connected in series with each other and a resistor, said second relay switch means is connected in parallel with said first relay switch means, gating means and resistor, and said delay circuit means comprises a capacitor connected in parallel with said first relay switch means and gating means, as well as with said second relay switch means.

8. A switching circuit for supplying electric power to a load from a power source, comprising:

a semiconductor switching element connected in series with the power source and load;

relay switch means for connecting the load and power source, wherein said relay switch means is connected in parallel with said semiconductor switching element and has an impedance which is substantially less than that of the semiconductor switching element; delay circuit means for controlling said relay switch means and said gating means; and gating means for enabling and disabling said semiconductor switching element; and delay circuit means for controlling said relay switch means and said gating means, said delay circuit means having a capacitor connected in parallel with said gating means, such that;

when supplying current to the load, said gating means first enables said semiconductor switching element so that current flows from the power source to the load only through said semiconductor switching element, and then said relay switch means is turned on so that current flows from the power source to the load through said relay switch means; and when cutting off the current to the load, said relay switch means is turned off first so that the current flows from the power source to the load only through said semiconductor switching element, and then said gating means is operated so as to disable said semiconductor switching element so that no current flows from the power source to the load.

* * * * *

UNITED STATES PATENT AND TRADEMARK OFFICE

CERTIFICATE OF CORRECTION

PATENT NO. : 4,855,612

DATED : August 8, 1989

INVENTOR(S) : Hirofumi KOGA et al.

It is certified that error appears in the above-identified patent and that said Letters Patent is hereby corrected as shown below: On the title page:

In the title, change "Current" to --Circuit--.

Signed and Sealed this

Fourteenth Day of August, 1990

*Attest:*

HARRY F. MANBECK, JR.

*Attesting Officer*

*Commissioner of Patents and Trademarks*